United States Patent [19]

Peterle

[11] Patent Number: 4,700,767

[45] Date of Patent: Oct. 20, 1987

[54] MOLDING MACHINE FOR MOLDING-SAND CORES

[76] Inventor: Guido Peterle, Via Novara 37, Borgomanero (Prov. of Novara), Italy

[21] Appl. No.: 907,438

[22] Filed: Sep. 16, 1986

[30] Foreign Application Priority Data

May 13, 1986 [IT] Italy ..... 20406 A/86

[51] Int. Cl.[4] ..... B22C 15/24

[52] U.S. Cl. ..... 164/201; 164/202; 164/228; 425/580

[58] Field of Search ..... 164/200–202, 164/228; 425/580, 406

[56] References Cited

U.S. PATENT DOCUMENTS

| | | | |
|---|---|---|---|
| 3,229,336 | 1/1966 | Hunter et al. | 164/200 X |
| 3,556,195 | 1/1971 | Lund | 164/201 X |
| 4,559,989 | 12/1985 | Kawai | 164/228 |

*Primary Examiner*—Charles Hart

*Attorney, Agent, or Firm*—Guido Modiano; Albert Josif

[57] ABSTRACT

A molding machine for molding-sane cores employing openable dies and an injection head with a cylindrical chamber, comprising a compressed air tank coaxial with the chamber, shutters for feeding air at the top of the chamber, movable supports for the head for shifting the head both horizontally and vertically from the working position to a lateral one, a raising piston connected to the lower die for vertically shifting the lower die against and away from the fixed upper die, a drilled gassing plate for gassing the core formed within the closed dies, mounted movable away from and towards the fixed upper die, a plate having dowels for raising and extracting the core formed by the lower die after it has been lowered relatively to the fixed one, an openable collet movable away from and towards the core in extracted position from the lower die and movable outside the machine to a finishing (trimming) station, programmed control and operating devices for obtaining the sequence of the operating phases, and extraction of the finished core.

8 Claims, 7 Drawing Figures

MOLDING MACHINE FOR MOLDING-SAND CORES

BACKGROUND OF THE INVENTION

The present invention relates to a molding machine for cores of molding sand, completely automatic and structured so as to allow to obtain cores, even small and therefore fragile and delicate ones, free from defects and with minimum production rejects.

As is known, molding machines for cores of molding sand employ a head for the violent injection, by means of compressed air, of the sand (usually sand and various additives) within dies or core boxes placed at the base of the head itself, which dies are composed of two semi-dies, divisible one from the other along a horizontal plane and, in some instances, along a vertical plane.

In the most recent machines, the head is provided with a cylindrical injection chamber, which is arranged vertically and is associated with a compressed air tank; furthermore, it is mounted movable horizontally, with respect to the core boxes, from a working position to a molding sand loading position and, possibly, also to a washing and maintenance position. The operating phases consist of feeding the sand into the cylindrical chamber up to a preset level, then feeding compressed air into the chamber itself so as to launch it, practically shoot it, within the core box associated with the base of the chamber, interrupting the air feed and separating and moving the head away from the molds.

Then a suitable treatment gas is fed in the core box, substantially for curing, then the dies are opened and moved apart; finally, extraction is performed, by various expulsion systems, of the core from one of the dies to which it has been left hanging, and the removal thereof is carried out on a conveyor belt or the like.

Machines of the prior art have, practically, several disadvantages, mostly due to the system for feeding compressed air into the chamber, for its discharge to the outside after packing the sand in the core box and to the system used for divaricating the dies and for unloading the molded core. Indeed, generally, the air fed from above generates turbulent motions and air bubbles which cause an insufficient and irregular distribution of the density of the sand which has been fed, as well as irregularities in the compactness and uniformity of the molded cores, with a consequent dangerous fragility and a high number of rejects. Similarly, the methods adopted for raising both dies in order to matchingly close them against each other and against the base of the injection chamber imply high constructive complexities, while the extraction of the molded core from the cavity (downwardly directed) of the upper die and its free fall onto a conveyor belt often entail irreparable damage to the core themselves, especially to those having small dimensions or being very complex.

SUMMARY OF THE INVENTION

Therefore, the aim of the present invention is to provide a molding machine for molding-sand cores, capable of eliminating the disadvantages presented by known machines and most of all such as to give rise to finished products with a regular packing and with high mechanical characteristics, no matter what the dimensions and the shape of the products may be.

Another object of the invention is to provide a molding machine with a compact structure, having control devices for the various operating phases with automatic and programmed intervention, together with a safe reliability and a high productivity.

These objects, and others which will better appear from the following description, are achieved by the molding machine for molding-sand cores according to the invention, comprising:

a sand injection head composed of a vertical cylindrical chamber, provided at the top with means for feeding compressed air into the top of the chamber itself, a supporting frame with vertical beams, an injection head endowed with a vertical cylindrical chamber and with a cylindrical tank, coaxial to the chamber itself, for compressed air, as well as with shutter means for the feed of the air itself to the chamber, horizontal-axis supporting and guiding means for the motion of said head from the working position to a lateral one at the end of the injection process, other vertical-axis means for guiding the motion of said chamber and associated tank, alternately and by means of a compressed-fluid device, from a raised position to a sealingly matching position with a lower plate on which is fixed a die for cores with the cavity directed downwardly, further vertical guiding means, placed laterally with respect to said supporting plate of the upper die, suitable to allow the lower die to be alternately brought closingly against the fixed upper die and subsequently openingly by means of a device operated by a compressed fluid, means for gassing the core formed in the two closed dies, composed of a drilled plate provided with conduits which are insertable in the upper die, movable both horizontally and vertically by means operated by compressed fluid, so as to be brought to engage with the closed die and then to be moved away laterally at the completion of the gassing process, a plate device, vertically movable, associated with a supporting plate for the lower die, suitable to be raised to extract and lift the core from the cavity of the die itself, and a collet device, placed laterally to the lower die, and endowed with lateral motion means to position itself on the core, for locking the core itself and for removing it from the die itself, and programmed means for controlling the operating phases from said cylindrical chamber filling with sand up to extraction of the finished product.

BRIEF DESCRIPTION OF THE DRAWINGS

The invention is described in greater detail hereinafter, according to a preferred and not exclusive practical embodiment, with reference to the accompanying drawing figures, where.

DESCRIPTION OF THE PREFERRED EMBODIMENTS

Figure 1:
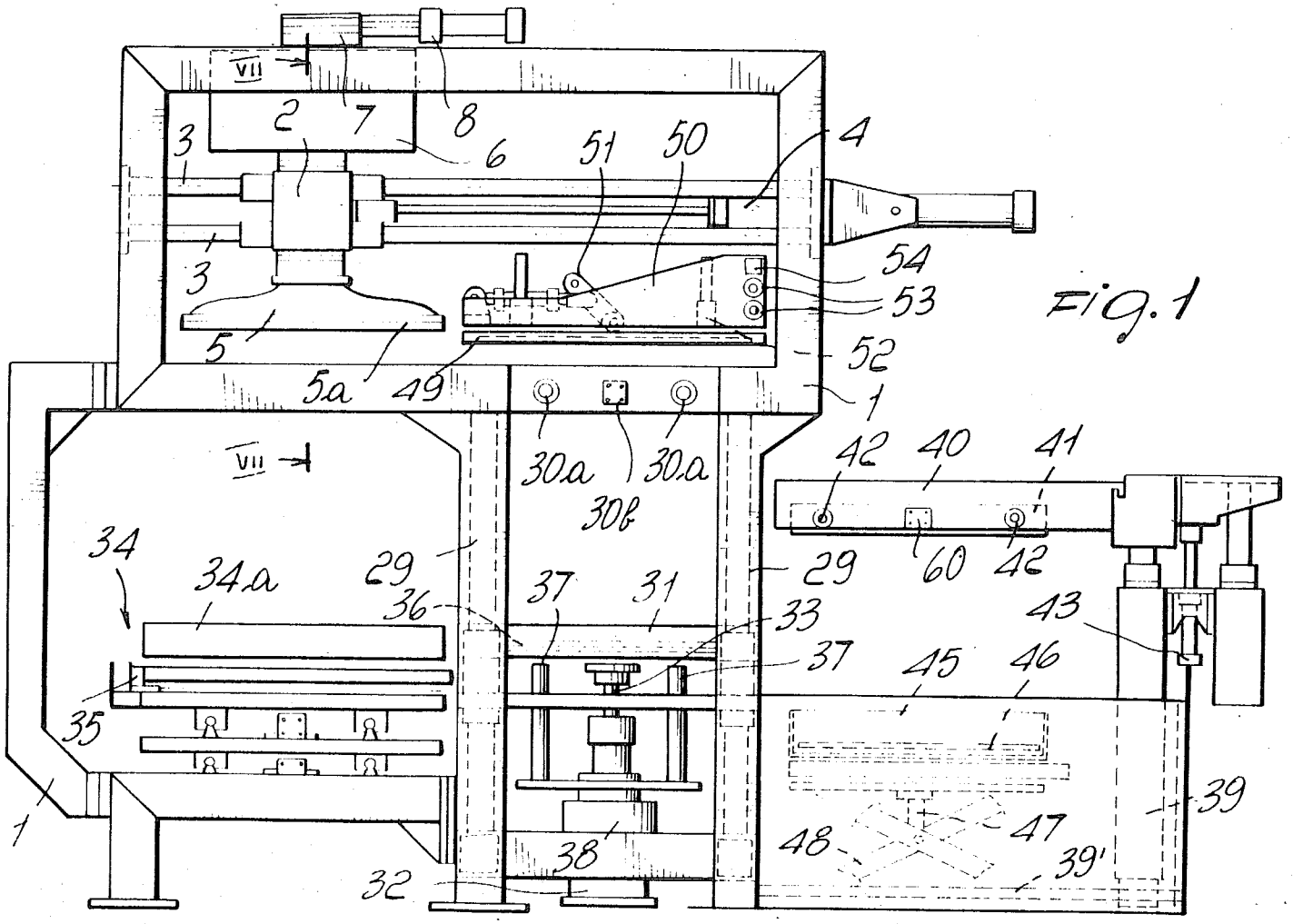
FIG. 1 is a schematic front view of a molding machine according to the invention, in resting position and without the dies.
Figure 7:
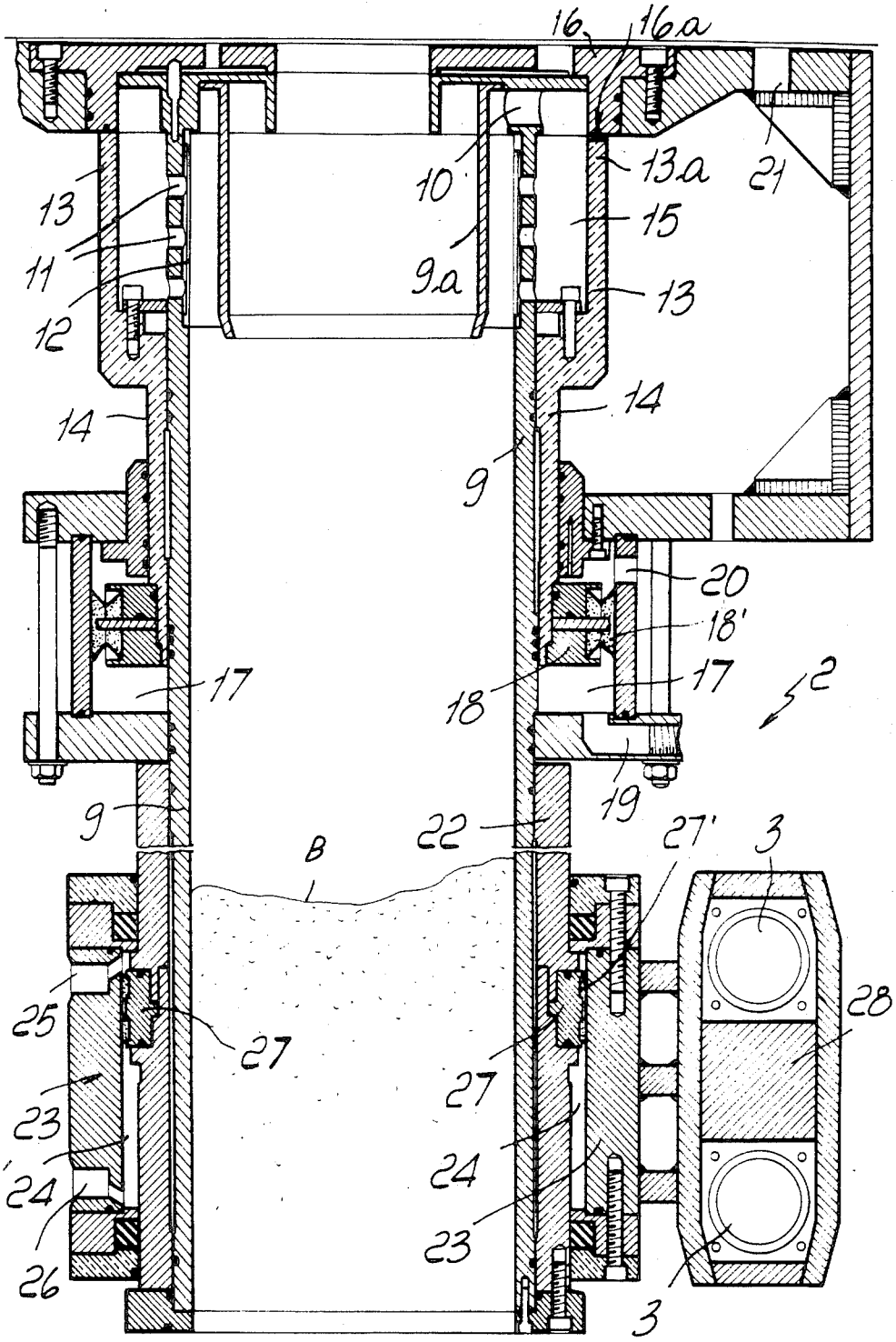
FIG. 7 is an axial-diametrical cross-sectional view of the injection head only, in a raised position relatively to the dies, taken along the line VII—VII of FIG. 1.

With reference to the abovementioned figures, and particularly to FIG. 1, the molding machine, according to the invention, comprises a supporting frame 1, at the top of which an injection head is arranged, generally indicated at 2, of the type having a cylindrical vertical chamber. The head 2 is mounted horizontally movable along parallel guides 3, as controlled by means of a compressed-fluid control cylinder 4. The internal structure of the injection head 2 is illustrated in FIG. 7, and will be described in detail hereinafter. The head 2 presents, in the lower part, a bell 5 for distributing the sand in the cylindrical chamber through a shooting plate 5*a* and is upwardly provided with a tank 6, which is coaxial to the chamber itself and contains compressed air.

The motion stroke, in both directions, of the head is provided so as to bring the bell 5 in contact with the dies (which will be described subsequently) and, after the injection of the sand, to return to the head itself to the lateral position for loading and cleaning. Above the tank 6 a valve 7 is placed, which is controlled by a piston 8 actuated by a compressed fluid and has the function of closing the upper inlet of the cylindrical chamber after the sand and the related additives have been loaded.

The injection head 2 is structured so as to prevent the compressed air fed from the coaxial tank 6 inside the vertical chamber from creating unwanted air bubbles and turbulent motions in the sand, which imply, as is known, an irregular density of the sand itself and an irregular compactness of the molded core.

Figure 3:
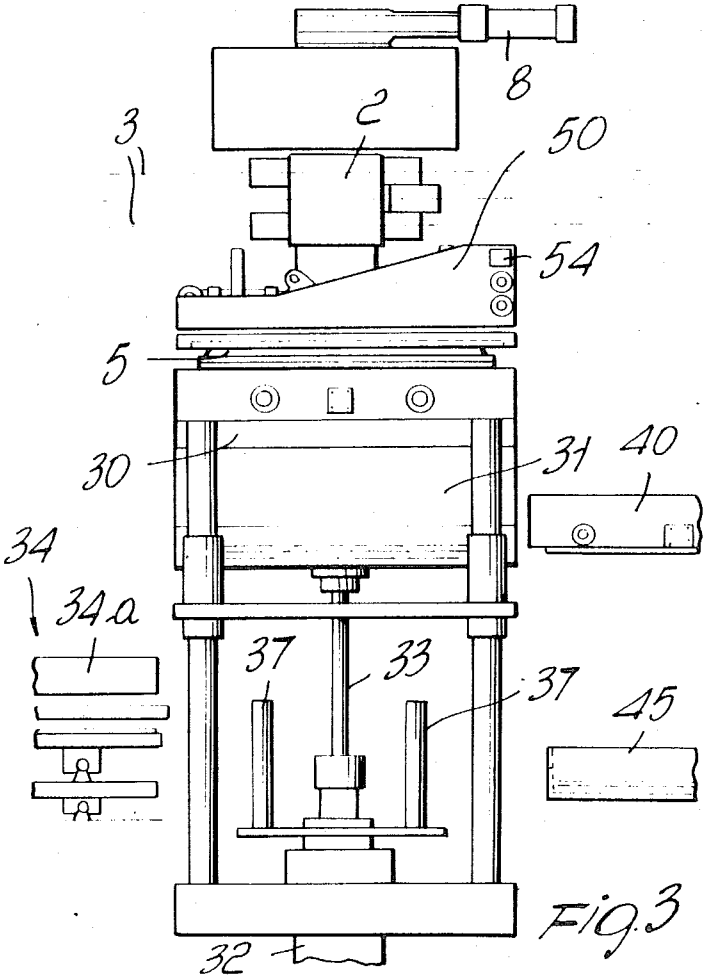
FIG. 3 is an analogous front view of the machine with the dies closed and the injection head in operating position.
Figure 2:
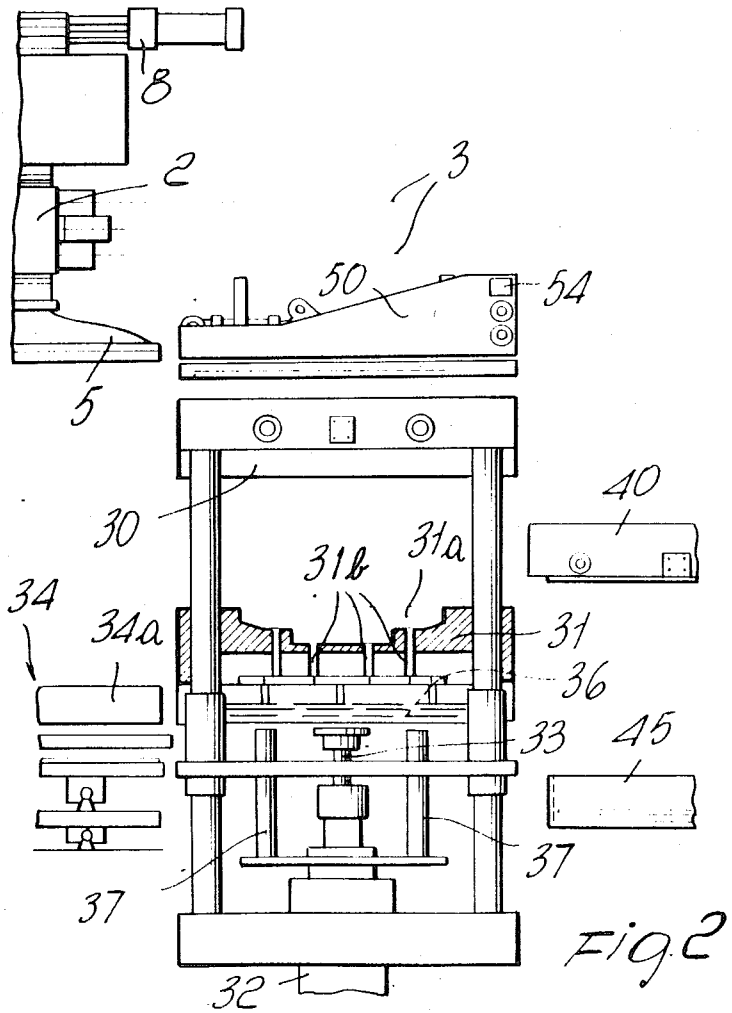
FIG. 2 is a schematic front view, partially in section, of the machine, in the molding start position, i.e. with the two dies in working position.

With particular reference to FIG. 7, the head object of the invention comprises a vertical cylindrical chamber 9 within which the molding sand is fed through said cutoff valve 7 and stopped when the level, indicated at B, has attained the preset value. Once the level has been attained, and with the cylindrical chamber 9 sealingly resting on the dies (see FIG. 3), the compressed air contained in the tank 6 is fed, mostly from above, through passage holes 10 and then in a direction axial to the chamber 9, and, for a lesser part, through radial holes 11, which are protected by an uninterrupted cylindrical net 12. The passage of the compressed air from the annular tank 6 the the interior of the chamber 9 is obtained by means of a shutter 13-14 coaxial to the chamber 9 itself. This shutter is composed of a cylindrical sleeve-like body with two diameters; the body 14 with smaller diameter is slideably and sealingly mounted on the outer surface of the chamber 9, while the body 13, having a greater diameter and slideable within the tank 6, creates an annular interspace 15 with the chamber itself.

Therefore, in the position illustrated in FIG. 7, the compressed air in the tank 6 cannot pass in the interspace 15, whereas when the shutter is retracted downwardly, between the top end 13*a* of the body 13 and the base 16*a* of a fixed sealing lid 16 an opening is created which allows the air to enter the interspace 15 and from there to pass into the chamber 9 through the holes 10, so as to direct itself coaxially with the cylindrical chamber 9 and also to pass through the holes 11 in a direction which is radial with respect to the chamber. The shutter is controlled by a hydraulically-operated device, comprising an annular chamber 17 of the operating fluid, rigidly coupled with the cylindrical chamber 9, and a piston body 18, also having an annular shape, associated with the shutter body, and having gaskets 18′ for sealing against the external wall of the annular chamber 17, thereby the piston body can be moved, in both directions, by feeding the pressurized fluid alternately through the inlets 19-20 and the shutter 13, 14 is alternately opened and closed.

The discharge of the air, after the injection and after closing the shutter, occurs through the hole 21 provided in the lid 16 of the chamber 1. To improve the distribution of the air, inside the chamber 9 a sleeve-like body 9*a* is provided, which is coaxial with the chamber 9, for directing all the compressed air, which enters the chamber both from the hole 10 and from the radial holes 11, in a direction which is axial to the cylindrical chamber 9; this solution allows to avoid turbulences and air bubbles inside the chamber 9. As previously described, the chamber 9 is vertically movable in both directions, with a preset stroke; in order to make the motions automatic, therefore, the chamber 9 is controlled by a hydraulically-operated device, substantially operating as a distributing valve and including a first cylindrical sleeve 22 coaxially fixed to the outside of the cylindrical chamber 9 and rigidly coupled with the body of the shutter chamber 17.

Outside the first sleeve 22, a second sleeve 23 is coaxially and fluid-sealingly mounted, which is shaped in such a way as to create between its internal surface and the first sleeve 22 an annular interspace 24 within which the compressed operating fluid is fed, alternatively, through the inlet-outlet lights 25 and 26. Inside the annular interspace 24, a protruding annular body 27, essentially a piston, is furthermore mounted, rigidly coupled with the first sleeve 22 and provided with gaskets 27′ for sealing against the internal cylindrical surface of the second sleeve 23; the same second sleeve 23 is rigidly mounted on a lateral support 28 which in turn is mounted horizontally movable along tubular guides 3, visible also in FIG. 1, by means of the piston 4, so as to slidably control the entire injection head assembly from the working position to a lateral position.

Again with reference to FIG. 1, the molding machine according to the invention furthermore comprises four guiding columns 29 above which a die 30, of a known kind, can be fixed, which can be blocked (FIGS. 2 to 6) between locking plates (not visible in the drawings, as covered by the frame 1) guided along horizontal bars 30*a* and operated by a cylinder 30*b* with a piston. The upper die 30 has its molding cavity directed downwardly.

The columns 29 further carry a second die 31, with its cavity 31*a* directed upwardly (FIG. 2), which is guided on the same columns under the first die 30 and is made alternately movable by means of a control cylinder 32 and related rod 33. Laterally to the resting position of the lower die 31, a trolley 34 is positioned, having two series of wheels and a die-holder plate 34*a* suitable for allowing the replacement of the die and its insertion between the columns 29 by means of a cylinder 35 and, at the end of the molding process, for extracting the same die.

Below the bottom plane of the die 31 (FIG. 2), a plate 36 is arranged, which is vertically movable by means of control rods 37 in turn operated by a cylinder 38. The plate 36 is provided (FIG. 5) with a series of dowels or pins 36*a*, which are vertical and pass through holes 31*b* provided in the lower core box or die 31, so that by lifting the plate 36 it is possible to expel the molded core from the cavity of the lower die, as will be better described hereinafter.

Figure 5:
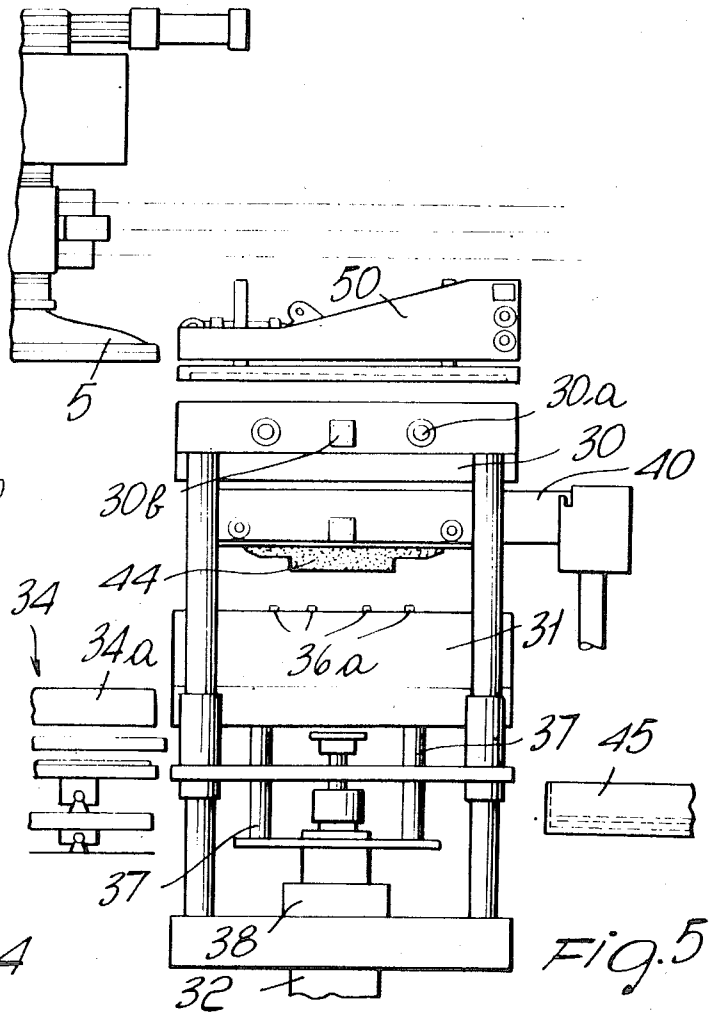
FIG. 5 is again an analogous view in the phase in which the core is extracted from the lower die.
Figure 4:
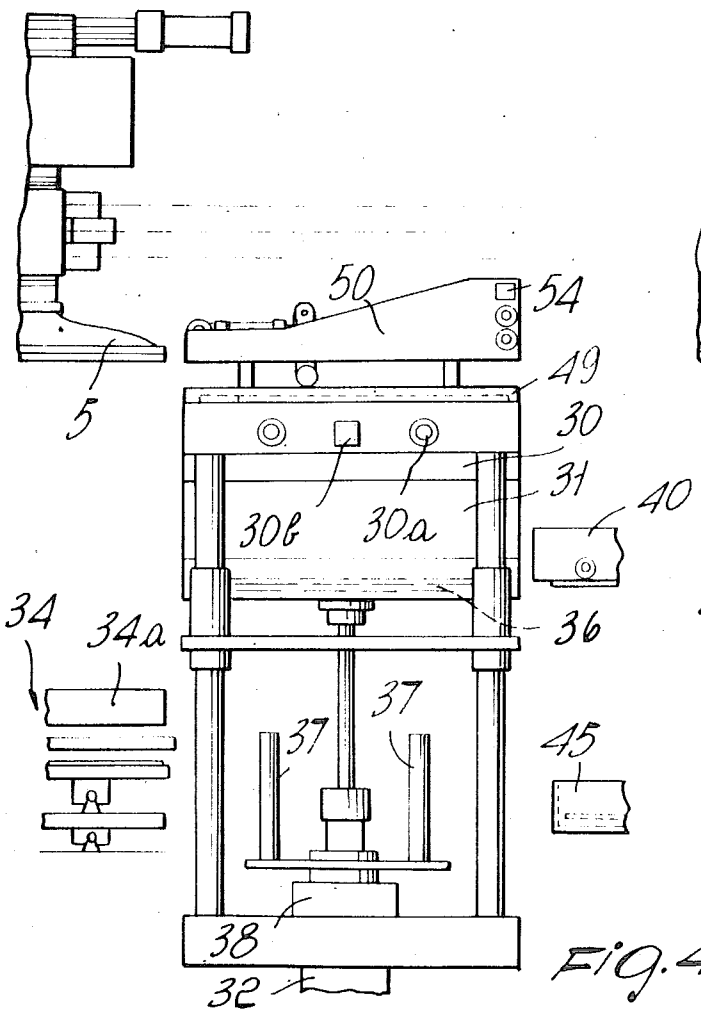
FIG. 4 is an analogous view with the gassing device positioned on the upper die.
Figure 6:
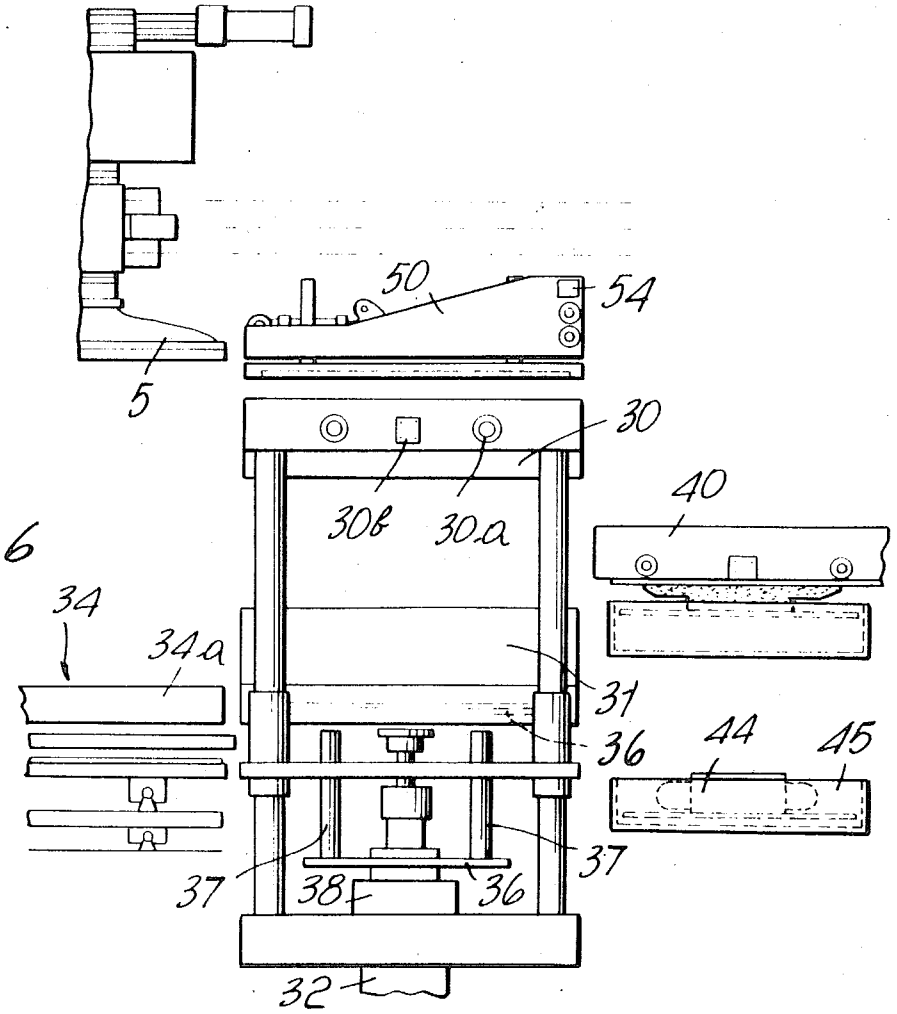
FIG. 6 is a further view of the machine during the formed core removal phase.

Furthermore, laterally to the guiding columns 29 of the lower die, a device is provided for gripping and removing the molded core after its extraction from the cavity 31*a*. This device is composed of a column 39, which can move away from and towards the columns 29 along guides 39' and carries at the top a protruding support 40 vertically movable through a cylinder 43. In turn the support 40 carries, keyed thereto, a fixed plate (not visible in the drawings) and, parallel thereto, a movable plate 41, the latter being slideable along tubular guides 42 and operated by a cylinder 60 (FIG. 1). The fixed plate and the movable one 41 form a collet which, after positioning at the sides of the molded core 44 raised from the lower die, grips the core itself, keeping it suspended between the collet plates and then transfers it laterally towards the discharge (FIG. 5). The discharge is substantially composed of a core collecting tank 45, inside which a usual plate 46 is arranged for trimming cores 44, which is operated by a cylinder 47; the tank 45 is then mounted on a device 48 for moving outwardly.

Finally, the molding machine is provided with a drilled gassing plate 49 (FIG. 1) having gassing conduits insertable in the upper die 30. The plate 49 is anchored to a support 50, which is provided with a lever device 51 which, by means of a control cylinder 52, causes lowering and raising of the gassing plate 49 relatively to the fixed upper die, as will be better described hereinafter. The same gassing plate and the related control are made movable from the position overlying the die to a lateral position, externally to the columns 29, by means of horizontal guides 53 and the related control piston 54.

The operation of the above described machine is briefly described as follows:

With the machine in the situation shown in FIG. 1, after loading of the molding sand in the cylindrical chamber 9 of the head 2, and after closing of the upper valve 7, the lower die 31 is raised by the cylinder 32 and brought to close against the fixed upper die 30. Then by means of the compressed-fluid cylinder 4 the injection head 2 is moved and brought vertically above the upper die. By then acting upon the device 22, 23 which controls the vertical motion of the head 2, lowering of the cylindrical injection chamber 9 is caused, until the chamber bell 5 is brought into contact with the fixed upper die 30, by feeding compressed fluid within the conduit 25 (FIG. 7). At the end of the downward motion of the injection chamber (see FIG. 3), by feeding compressed fluid in the chamber 17 of the shutter 13-14 through the light 20, the shutter 13, 14 is opened and compressed air may be fed from the tank 6 into the interspace 15 and then into the injection chamber 9. Thereby the sand is injected inside the closed die 30, 31 through a plurality of conduits provided in the body of the upper die 30. Once the injection has been performed, the injection chamber is first raised by means of compressed fluid fed into the raising device through the light 26 (FIG. 7), and then moved laterally by means of the cylinder 4. Then gassing of the core enclosed in the dies is performed by moving the gassing device 49–52 along the guides 53 by means of the piston 54 up to the upper die 30 and by lowering the gassing plate 49 by means of the mechanism 51, 52 (see FIG. 4). Once gassing has been performed, the device 49–52 is raised and then moved laterally by means of the control piston 54. At this point, the core 44 is ready to be extracted from the dies and moved away. For this purpose, by means of the cylinder 32, the lower die 31 is lowered and the core 44, protruding upwardly out of the die 31, is extracted and raised by means of the extracting dowels 36*a* carried by the extraction plate 36 and operated by the lower cylinder 38. The core will then be delicately gripped by the collet defined by the fixed plate and by the movable plate 47, moved over the core along the guides 39' and positioned at the right height through the cylinder 43, and is then moved laterally into the tank 45 in which the core itself, still held by the collet, is cleaned of any burr by means of the trimming plate 46. The core, so cleaned is then evacuated by means of the transporting trolley 48.

All the operating phases are controlled by a programmed control unit, so as to control the sequence of the phases from injection chamber filling to finished core removal.

Naturally, the machine described above according to a preferred embodiment thereof can be subject to structurally and functionally equivalent modifications and variations, without departing from the scope of the invention itself.

I claim:

1. A molding machine for molding-sand cores, comprising, in combination:

a supporting frame, two opposite upper and lower dies, including one fixed die and one movable die carried by said supporting frame, a sand injection head including a vertical cylindrical chamber, a cylindrical compressed air tank, coaxial to said chamber, and shutter means for feeding compressed air to said cylindrical chamber, horizontal-axis supporting and guiding means for supporting and guiding said injection head from a working position to a lateral one and vice-versa, vertical-axis guiding means for guiding said injection head, alternately and by means of a compressed-fluid device, from a raised position to a sealingly matching position with said upper die, vertical guiding means, carried on said supporting frame and including a compressed-fluid operating device operatively connected to said movable die for alternately bringing said movable die closingly against said fixed die and subsequently bringing said movable die away from said fixed die, gassing means for gassing a core formed in said dies, including a gassing plate and compressed-fluid operated guiding means operatively connected to and horizontally and vertically guiding said gassing plate for bringing said gassing plate alternately in engagement with said opposite dies, when they are in their closed condition, and then laterally away, a movable plate device having extracting dowels, and a raising device, said movable plate device being associated with said lower die for extracting and lifting a formed core from said lower die, a collet device, carried on said supporting frame and including a collet and lateral motion means for bringing said collet at said lower die, when said dies are in their opened condition, locking a formed core and for removing it from said lower die, and programmed means for controlling the operation of said guiding means, said raising means and said lateral motion means, thereby controlling the operating phases of said machine from said cylindrical chamber filling with sand up to extraction of a formed core.

2. A machine according to claim 1, wherein said shutter means comprises a cylindrical sleeve-like body extending coaxially around and at a distance from said cylindrical chamber and being at least partially surrounded by said cylindrical tank, said shutter means further including a hydraulic operating device including an annular chamber extending around said cylindrical chamber and accommodating an operating member rigid with said sleeve-like body, said annular chamber defining compressed-fluid inlet openings and being alternately fed with compressed fluid acting on said operating member for causing translation of said sleeve-like body along said cylindrical chamber and allowing compressed air from said compressed air tank inside said cylindrical chamber.

3. A machine according to claim 2, wherein said cylindrical chamber at its top portion, facing said compressed air tank, has radial holes for allowing the compressed air from said compressed air tank to flow radially in said cylindrical chamber with said shutter means in its opening position, said cylindrical chamber accommodating on its interior a cylindrical sleeve-like distribution body, coaxial with said cylindrical chamber and forming therewith a cylindrical interspace for directing said compressed air to flow axially within said cylindrical chamber.

4. A machine according to claim 1, wherein said vertical-axis guiding means comprises at least one sleeve coaxially arranged around said cylindrical chamber and rigidly coupled with said horizontal-axis supporting and guiding means, said sleeve defining with said cylindrical chamber an annular interspace accommodating an operating body rigidly coupled with said cylindrical chamber, said sleeve defining compressed fluid inlet openings for alternately allowing feeding compressed fluid into said annular interspace and actuation of said operating body and thereby axial motion of said cylindrical chamber away from and towards said dies in closing position.

5. A machine according to claim 1, wherein said dies are mounted openable along a horizontal plane, said upper die being fixed and rigidly carried by said supporting frame and said lower die being movable, removably carried on a support plate operated by a compressed-fluid cylinder of said vertical guiding means.

6. A machine according to claim 1, wherein said compressed-fluid operated guiding means includes a mechanism with oscillating levers operated by a compressed-fluid cylinder to thereby lower and raise said gassing plate on and away from said upper die.

7. A machine according to claim 5, wherein said vertical guiding means is associated with a movable plate having upwardly protruding dowels penetrating in said lower die to cause the extraction of a formed core from said lower die.

8. A machine according to claim 1, wherein said collet device comprises a horizontally translating column carrying a fixed plate rigid therewith and a movable plate parallel to said fixed plate and slidable along guiding members as actuated through a compressed-fluid cylinder, said columns with said plates being horizontally movable between said dies and a trimming device to thereby transfer a formed core from said dies to said trimming device.

* * * * *